US007466285B2

(12) United States Patent
Lin et al.

(10) Patent No.: US 7,466,285 B2
(45) Date of Patent: Dec. 16, 2008

(54) FINE TUNING MECHANISM OF A SATELLITE ANTENNA

(75) Inventors: Hung-Yuan Lin, Taipei (TW); San-Yi Kuo, Taipei (TW); Wen-Jih Yeh, Taipei (TW)

(73) Assignee: Wistron Neweb Corp., Taipei (TW)

( * ) Notice: Subject to any disclaimer, the term of this patent is extended or adjusted under 35 U.S.C. 154(b) by 75 days.

(21) Appl. No.: 11/296,296

(22) Filed: Dec. 8, 2005

(65) Prior Publication Data

US 2007/0046553 A1 Mar. 1, 2007

(30) Foreign Application Priority Data

Aug. 31, 2005 (TW) ..... 94215034 U

(51) Int. Cl.
*H01Q 3/02* (2006.01)
*H01Q 1/12* (2006.01)
*H01Q 3/00* (2006.01)

(52) U.S. Cl. ..... 343/882; 343/878; 343/757

(58) Field of Classification Search ..... 343/882, 343/757, 892, 881, 878, 880, 765; 359/399, 359/430; 211/170, 172
See application file for complete search history.

(56) References Cited

U.S. PATENT DOCUMENTS

| | | | | |
|---|---|---|---|---|
| 5,103,236 | A * | 4/1992 | DuShane | 343/765 |
| 5,576,722 | A * | 11/1996 | Bustillos | 343/882 |
| 6,445,361 | B2 * | 9/2002 | Liu et al. | 343/882 |
| 6,864,855 | B1 * | 3/2005 | Fujita | 343/882 |
| 7,142,168 | B1 * | 11/2006 | Sinclair | 343/882 |
| 2005/0264467 | A1 * | 12/2005 | Lin et al. | 343/882 |
| 2006/0181477 | A1 * | 8/2006 | Lin et al. | 343/880 |

* cited by examiner

*Primary Examiner*—Hoang V Nguyen
*Assistant Examiner*—Robert Karacsony
(74) *Attorney, Agent, or Firm*—Stout, Uxa, Buyan & Mullins, LLP

(57) ABSTRACT

A fine tuning mechanism of the satellite antenna is disclosed herein. This mechanism disposed in the elevation and azimuth fine tuning device includes a plurality of fine tuning elements, which include a plurality of rollers, a bushing and a bearing. By this mechanism, it is easy to tune to the needed angle with high accuracy. The user can use the handle to easily tune the right elevation and azimuth.

8 Claims, 3 Drawing Sheets

FINE TUNING MECHANISM OF A SATELLITE ANTENNA

BACKGROUND OF THE INVENTION

1. Field of the Invention

The present invention generally relates to a fine tuning mechanism of the satellite antenna, and more particularly to an elevation and azimuth fine tuning mechanism of the satellite antenna.

2. Description of the Prior Art

Parabolic satellite antenna is a high-directional receiving antenna. The center of the parabolic antenna should be accurately aligned to the satellite in the aerospace. At present, the signal frequency of the satellite is rising from KU to KA. This leads to a higher sensitivity on the directionality of the satellite signals. (Also means narrower Antenna Radiation Lobes Beamwidth). The traditional satellite antennas are without the fine tuning mechanisms. The fine tuning for the azimuth is all done by hand. This suffers the disadvantages of time-wasting and hard to accurately receive the single from the satellite. By using this method to fine tuning the antenna, the step, lock-down, is usually generating a displacement from the position of the original angle.

SUMMARY OF THE INVENTION

In view of the foregoing, it is an object of the present invention to improve the fine tuning mechanism of the satellite antenna such that it is able to work without the lock-down step after fine tuning and avoids generating the displacement. This also makes the fine tuning procedure smoothly, decreasing the tuning forces, and increasing the sensitivity of azimuth fine tuning.

A further object of the present invention is to provide a fine tuning mechanism of the satellite antenna, in which the fine tuning angle is able to highly accurate alignment, and easily to align to the precise positions for the elevation and azimuth.

According to one embodiment of the present invention, in order to increase the sensitivity of the azimuth and reduce the gaps during fine tuning procedure, a bolt was fastened into a bearing between the azimuth bracket and mount base of this mechanism. This makes the fine tuning of the azimuth smoother. By using this mechanism, die screw force during fine tuning procedure is lowered by eliminate the gaps among rotation center. In order to recognize the properties and the functions, die details are described as die following sections.

Further scope of the applicability of die present invention will become apparent from the detailed description given hereinafter. However, it should be understood that the detailed description and specific examples, while indicating preferred embodiments of the invention, are given by way of illustration only. since various changes and modifications within the spirit and scope of the invention will become apparent to those skilled in the art from this detailed description.

The present invention will become more fully understood from the detailed description given hereinbelow and the accompanying drawings which are given by way of illustration only, and thus are not limitative of the present invention, and wherein:

DETAILED DESCRIPTION OF THE INVENTION

This invention is a fine tuning mechanism of the satellite antenna. Based on the prior conventional mechanism, this invention introduces the new parts, that comprising rollers, bearings and bushings. The objectives of the rollers are to increase the sensitivity, decrease the wear and tear of the mechanism during the fine tuning procedure. The objectives of the bearings and bushings are in order to smooth the rotation and to avoid to get stuck by the abrasion among the materials of the parts. By combination of these parts into this mechanism, the stability is able to enhance during the fine tuning procedure.

Figure 1:
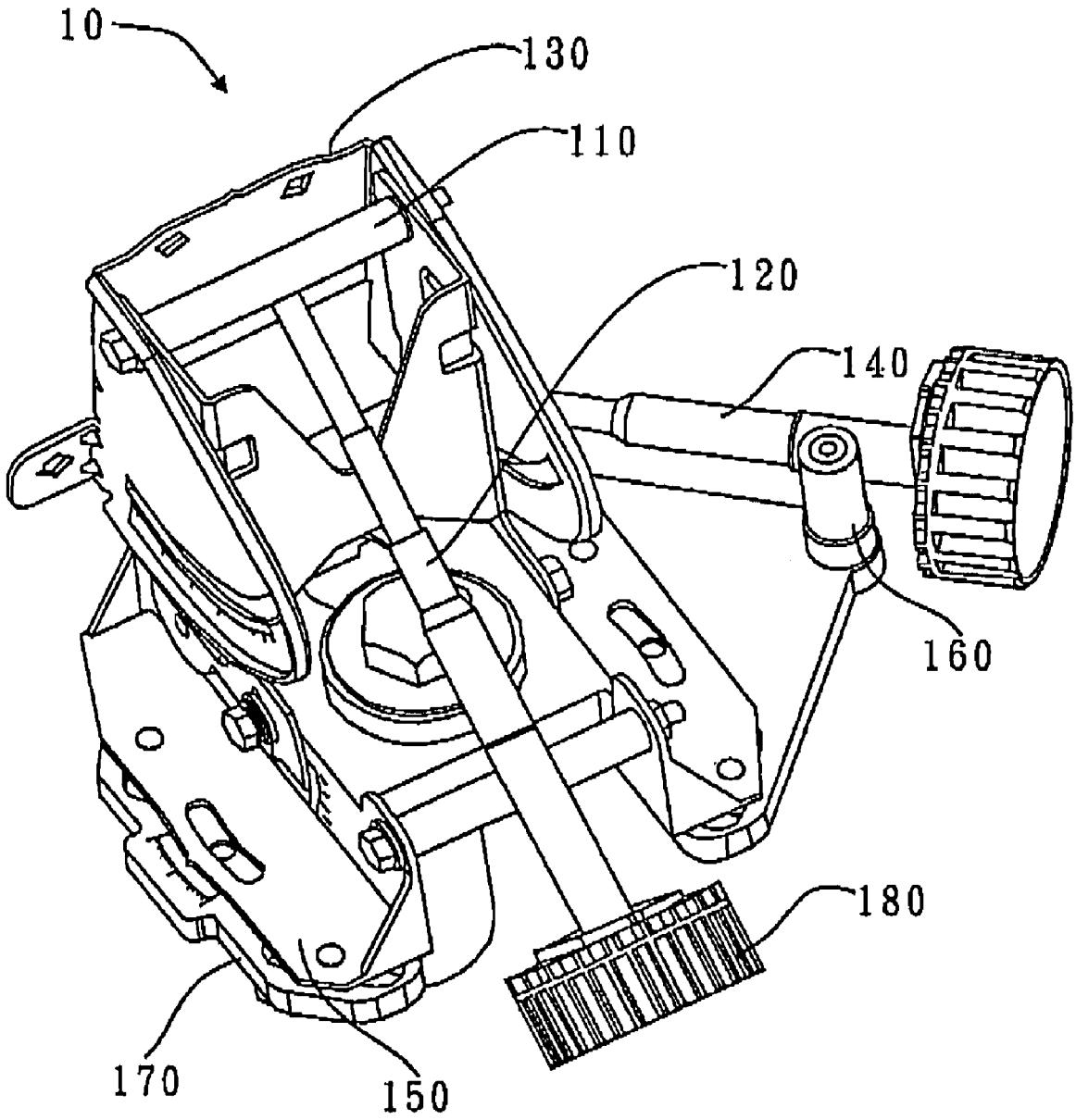
FIG. 1 schematically illustrates a perspective view, revealing the layout of the fine tuning mechanism of the satellite antenna according to one embodiment of the present invention.

FIG. 1 schematically illustrates the perspective view of the fine tuning apparatus 10 of the satellite antenna, in which the basic structure of the fine tuning apparatus includes an elevation fine tuning bolt 110, an elevation fine tuning shaft 120, an elevation bracket 130, an azimuth fine tuning shaft 140, an azimuth bracket 150, a hollow column 160, a mount base 170, a handle 180 etc. The function of the apparatus 10 is on fine tuning the elevation and azimuth of the satellite antenna. The objectives of this invention is disposed a fine tuning mechanism between the azimuth bracket 150 and mount base 170, by which, the sensitivity will be increased, the friction will be decreased, and the case of parts-locked by the abrasion of materials will be avoided.

Figure 2:
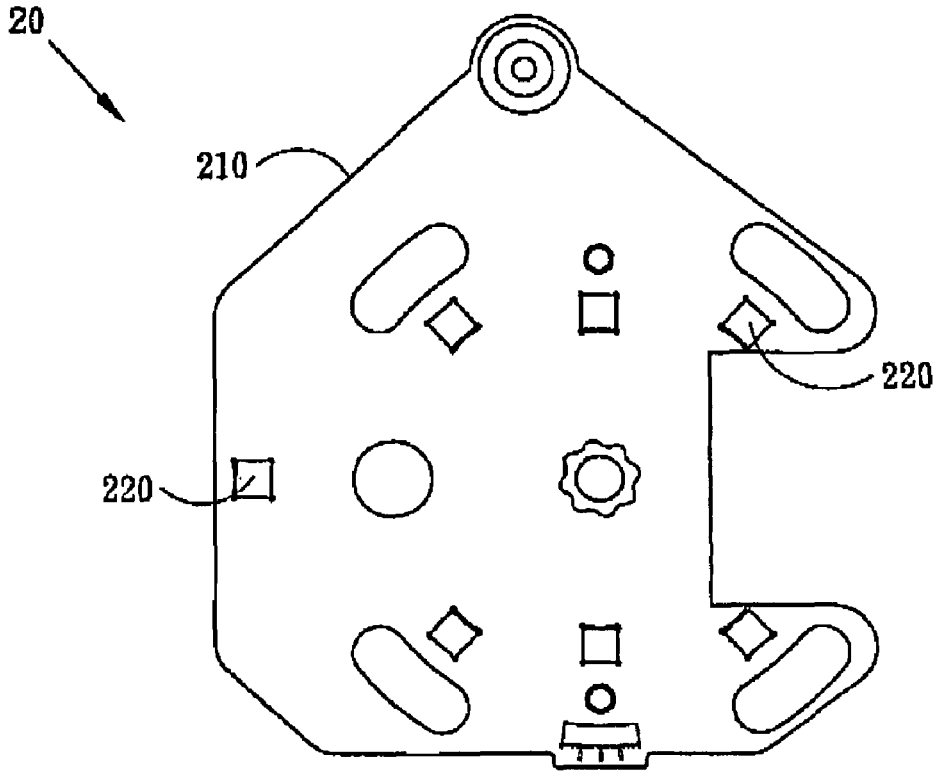
FIG. 2 schematically illustrates a top cross-sectional view of the roller arrangement of the fine tuning mechanism of the satellite antenna according to one embodiment of the present invention.

FIG. 2 is the top cross-section view of the fine tuning mechanism 20, showing the arrangement of the rollers 220. These rollers are fixed on the mount base 210 and arranged iii a circular formation between the mount base 210 and the azimuth bracket 150. The azimuth bracket 150, which is fixed by the bolts on the corners, and the mount base 210 are inter-rotating with each other during die fine tuning procedure. By the surface contact and the induced action between the rollers 220 and the azimuth bracket, this design is not only decreasing the unnecessary friction, but also efficiently increasing the sensitivity of the fine tuning mechanism, and help to lower the rotating forces during the fine tuning procedure. The number of the roller 220 in the embodiments is either two, four, six, or eight and so on, as long as the mechanism is able to maintain in balance and increasing the sensitivity.

Figure 3:
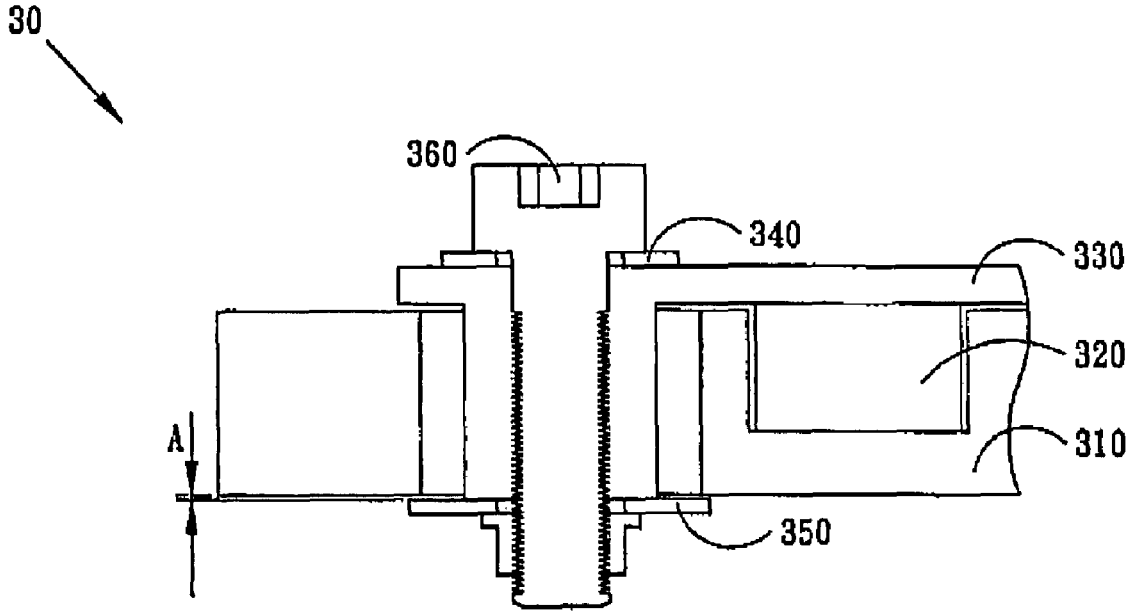
FIG. 3 schematically illustrates the side cross-sectional view, showing the position relationship of the mount base and azimuth bracket of the fine tuning mechanism according to one embodiment of the present invention.

FIG. 3 schematically illustrates the side cross-section view of the part of the assembly 30 that fixed on the mount base 310. The mount base 310 has a room where the rollers 320 are disposed and the azimuth bracket 330 is then dispose on top of the rollers 320, using top washer 340 and the bottom washer 350 clipping these parts, and the bolt 360 fixing the parts together. When the azimuth bracket 330 is under a normal applying force, it is higher compared with the mount bracket 320 by the design and an interval, A, between these two parts is about 0.02-0.05 mm in length. When the azimuth bracket 330 and the mount base 310 are fixing by the bolt and under an applying force, because of the interval A, the washer will not generate a huge friction by tightly locked, and the sensitivity of the azimuth fine tuning will not be affected.

Figure 4:
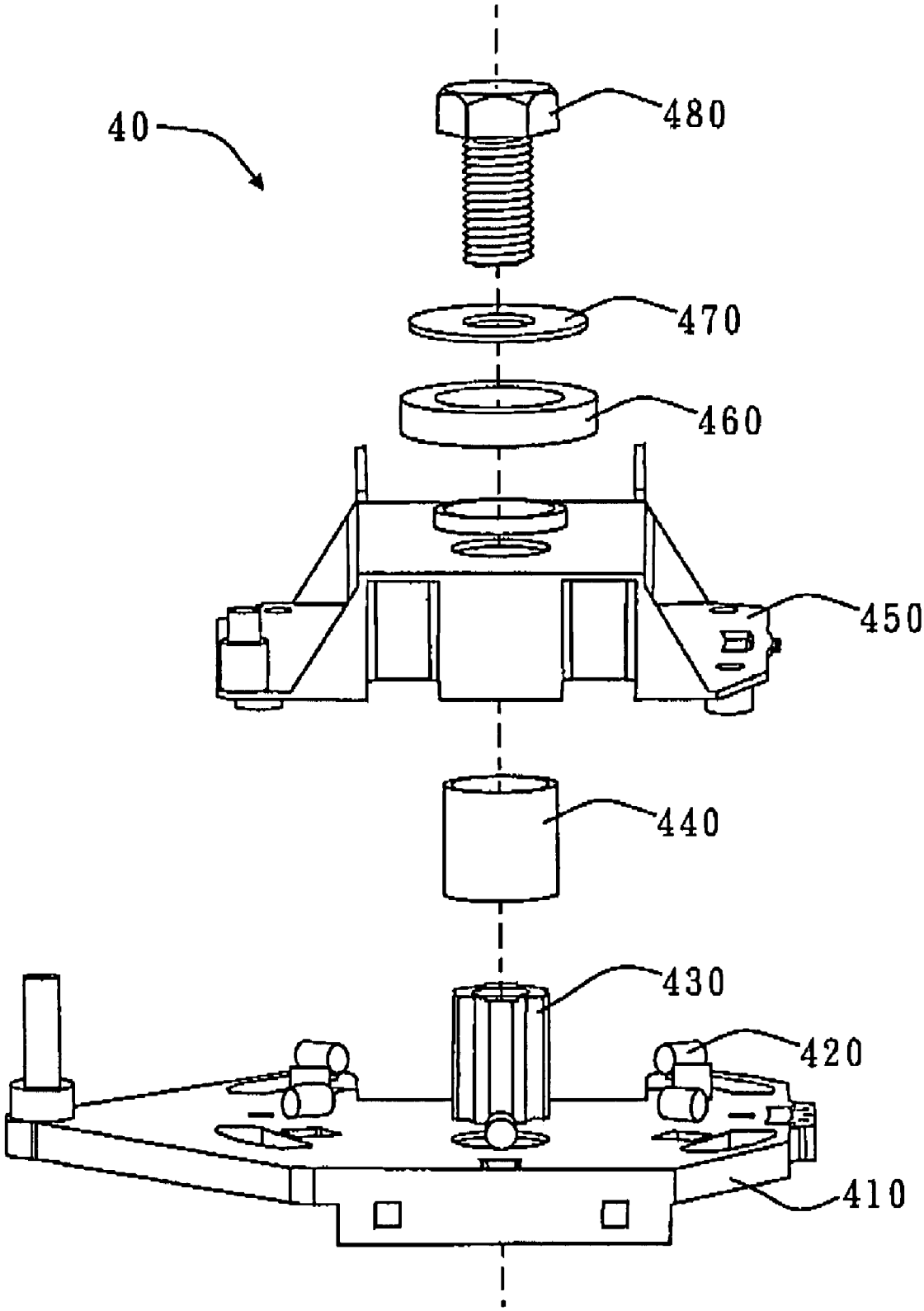
FIG. 4 schematically illustrates the position relationship of the parts of the fine tuning mechanism, according to one embodiment of the present invention.

FIG. 4 schematically illustrates the perspective view of the fine tuning mechanism 40, comprising a mount base 410, a plurality of the rollers 420, a pillar 430, a bushing 440, an azimuth bracket 450, a thrust bearing 460, a nut 470, and a bolt 480. A plurality of the rollers 420 are disposed on the mount base 410 and arranged in a circular formation. The pillar is disposed in the center of the mount base. The bushing 440 is put between the mount base 410 and the azimuth bracket 450. The thrust bearing 460 is on the azimuth bracket 450 and just below the nut 470 and the bolt 480.

According to the figure 4, in order to increase the sensitivity of the fine tuning mechanism, between the mount base 410 and the azimuth bracket 450, the bushing 440, which is tightly fixing on the mount base 410, and the thrust bearing 460, which is connected with the azimuth bracket 450, are combined with the designed rollers 420 to increase the stability of the fine tuning of the azimuth.

In this invention, the introduced rollers are to improve the sensitivity during the fine tuning procedure. Besides the detailed description of the previous embodiment, it is appreciated that the quantity of the rollers may be greater or less than that disclosed, or the arrangement of the rollers may be changed but complies with the principle of symmetry to achieve the expectant objectives of the invention. The function of the thrust bearing is to smooth the action of the mechanism. If the bearing is omitted, the function of the rollers is still working by slightly increasing the applying forces, as well as the function of the fine tuning mechanism. Otherwise, the quantity of the bushing may be grater or less than that disclosed, by partially modified to achieve the objectives.

As the invention may be embodied in several forms without departing from the spirit of essential characteristics therefore illustrative and not restrictive, and all changes that fall within meets and bounds of the claims, or equivalence of such meets and bounds are therefore intended to be embraced by the claims.

What is claimed is:

1. A fine tuning mechanism of a satellite antenna, said fine tuning mechanism comprising:

a mount base;

a pillar, said pillar disposed at the center of said mount base;

an azimuth bracket, said azimuth bracket assembled on the mount base;

a bolt, said bolt inserted into said pillar so as to lock said azimuth bracket and said mount base;

a plurality of rollers, said rollers being disposed on said mount base and contacted with said azimuth bracket; and a thrust bearing, said thrust bearing being disposed between said bolt and said azimuth bracket, wherein an interval between said azimuth bracket and said mount base is about 0.02-0.05 mm.

2. A fine tuning mechanism of a satellite antenna, said fine tuning mechanism comprising:

a mount base;

a pillar, said pillar disposed at the center of said mount base;

an azimuth bracket, said azimuth bracket assembled on the mount base;

a bolt, said bolt inserted into said pillar so as to lock said azimuth bracket and said mount base;

a plurality of rollers, said rollers being disposed on said mount base and contacted with said azimuth bracket;

a bushing disposed between said mount base and said azimuth bracket, and a thrust bearing disposed between said bolt and said azimuth bracket, wherein said pillar is inserted into said bushing.

3. A satellite antenna comprising:

an adjustable module comprising a plurality of rollers and a pillar disposed on said module; and a bolt attached to said pillar;

a fixed module disposed above said adjustable module by said bolt, wherein a surface of said fixed module is attached with said rollers and an interval between said fixed module and said adjustable module is about 0.02-0.05 mm.

4. The satellite antenna according to claim 3, further comprising a thrust bearing disposed between said bolt and said adjustable module.

5. The satellite antenna according to claim 3, wherein said rollers are arranged in a ring.

6. The satellite antenna according claim 3, further comprising:

a bushing disposed between said adjustable module and said fixed module, and a thrust bearing disposed between said bolt and said fixed module.

7. The satellite antenna according claim 6, wherein said pillar is inserted into said bushing.

8. The satellite antenna according claim 3, further comprising a bushing, wherein said pillar is inserted into said bushing.

* * * * *